US011530605B2

(12) United States Patent
Gunsaulis et al.

(10) Patent No.: US 11,530,605 B2
(45) Date of Patent: Dec. 20, 2022

(54) HORIZONTAL DIRECTIONAL DRILLING CROSSBORE DETECTOR

(71) Applicants: The Charles Machine Works, Inc., Perry, OK (US); Louisiana Tech Research Corporation, Ruston, LA (US)

(72) Inventors: Floyd R. Gunsaulis, Perry, OK (US); Richard F. Sharp, Perry, OK (US); Arun Prakash Jaganathan, Ruston, LA (US); David Edward Hall, Ruston, LA (US); Neven Simicevic, Ruston, LA (US)

(73) Assignee: The Charles Machine Works, Inc., Perry, OK (US)

( * ) Notice: Subject to any disclaimer, the term of this patent is extended or adjusted under 35 U.S.C. 154(b) by 320 days.

(21) Appl. No.: 15/068,793

(22) Filed: Mar. 14, 2016

(65) Prior Publication Data

US 2016/0265347 A1 Sep. 15, 2016

Related U.S. Application Data

(60) Provisional application No. 62/133,012, filed on Mar. 13, 2015.

(51) Int. Cl.

| | |
|---|---|
| ***G01V 3/00*** | (2006.01) |
| ***E21B 47/10*** | (2012.01) |
| ***E21B 47/01*** | (2012.01) |

(52) U.S. Cl.

CPC ..... *E21B 47/10* (2013.01); *E21B 47/01* (2013.01)

(58) Field of Classification Search

CPC ..... E21B 47/122; E21B 7/046; E21B 47/02; E21B 47/10; E21B 47/01

See application file for complete search history.

(56) References Cited

U.S. PATENT DOCUMENTS

| | | | | | |
|---|---|---|---|---|---|
| 3,852,709 | A | * | 12/1974 | Mueller | G03H 3/00 367/9 |
| 4,345,106 | A | * | 8/1982 | Canfield | C03B 5/245 73/290 R |
| 4,600,356 | A | * | 7/1986 | Bridges | E02F 9/245 172/6 |
| 5,231,355 | A | * | 7/1993 | Rider | G01V 3/08 324/67 |
| 5,264,795 | A | * | 11/1993 | Rider | G01V 3/06 324/67 |

(Continued)

OTHER PUBLICATIONS

Jansen—Short Range Object Detection and Avoidance (Year: 2010).*

(Continued)

*Primary Examiner* — Quang Pham

(74) *Attorney, Agent, or Firm* — Tomlinson McKinstry, P.C.

(57) ABSTRACT

A crossbore detection system. The system is located in a downhole tool proximate a drill bit. The system comprises circuitry sensitive to a subsurface environment and a sensor that detects changes in the circuitry. The sensor detects changes in the circuitry that indicates that the drill bit has struck an underground pipe. The sensor may detect a series of electromagnetic signals indicative of the strike or may detect changes to an impedance bridge at a capacitive sensor.

25 Claims, 6 Drawing Sheets

(56) References Cited

U.S. PATENT DOCUMENTS 5,361,029 A * 11/1994 Rider ..... G01R 31/60 324/67
5,647,439 A * 7/1997 Burdick ..... E01C 19/004 701/50
5,673,050 A * 9/1997 Moussally ..... G01S 13/0209 342/25 F
5,878,825 A * 3/1999 Okuyama ..... E21B 7/046 175/45
5,904,210 A * 5/1999 Stump ..... E21B 47/13 175/45
5,905,458 A * 5/1999 Ashihara ..... G01S 13/583 342/111
6,055,214 A * 4/2000 Wilk ..... G01S 15/89 89/1.13
6,079,269 A * 6/2000 Dilz, Jr. ..... A63B 24/0021 73/488
6,252,538 B1 * 6/2001 Chignell ..... G01S 13/0209 342/195
6,308,787 B1 * 10/2001 Alft ..... E21B 44/00 175/48
6,313,755 B1 * 11/2001 Hetmaniak ..... E21B 47/0228 340/856.1
6,603,314 B1 * 8/2003 Kostelnicek ..... G01V 3/24 324/371
6,755,263 B2 * 6/2004 Alft ..... E21B 7/06 175/61
6,833,795 B1 * 12/2004 Johnson ..... G01V 3/12 340/853.8
7,091,872 B1 * 8/2006 Bigelow ..... H02G 9/02 340/310.15
7,769,867 B2 * 8/2010 Fukuda ..... H04N 1/00161 348/231.9
8,729,900 B1 * 5/2014 Dunn ..... G01V 3/08 324/326
8,957,683 B2 * 2/2015 Bittar ..... G01V 3/30 324/345
9,391,470 B2 * 7/2016 Patino ..... H02J 50/60
9,651,711 B1 * 5/2017 Olsson ..... E21B 7/046
2002/0010547 A1 * 1/2002 Hall ..... E21B 47/024 702/6
2002/0063652 A1 * 5/2002 Price ..... E02F 9/245 342/22
2002/0066309 A1 * 6/2002 Tubel ..... E21B 47/135 73/152.54
2002/0183013 A1 * 12/2002 Auckland ..... H01Q 1/243 455/73
2004/0155810 A1 * 8/2004 Witten ..... G01S 13/88 342/179
2004/0168358 A1 * 9/2004 Stump ..... G01C 15/00 37/348
2004/0256159 A1 * 12/2004 Alft ..... E21B 7/265 175/61
2005/0056460 A1 * 3/2005 Sharp ..... E21B 7/046 175/19
2005/0249503 A1 * 11/2005 Sun ..... E21B 47/12 398/135
2006/0039221 A1 * 2/2006 Fukuda ..... H04N 1/00137 365/222
2007/0103162 A1 * 5/2007 Morys ..... G01V 3/24 324/367
2008/0185903 A1 * 8/2008 Bausov ..... E21C 35/08 299/1.2
2008/0218400 A1 * 9/2008 Stolarczyk ..... G01V 3/12 342/22
2009/0167589 A1 * 7/2009 Bausov ..... G01S 13/32 342/22
2009/0183917 A1 * 7/2009 Sharp ..... E21B 7/046 175/40
2009/0200016 A1 * 8/2009 Goodwin ..... G01V 3/30 166/248
2010/0012377 A1 1/2010 Sharp et al.
2010/0019771 A1 * 1/2010 Gold ..... G01V 3/24 702/7
2010/0059219 A1 * 3/2010 Roberts ..... E21B 47/002 166/250.01
2010/0148788 A1 * 6/2010 San Martin ..... G01V 3/24 324/369
2010/0259267 A1 * 10/2010 Rosthal ..... G01V 3/30 324/339
2010/0295548 A1 * 11/2010 Georgi ..... G01V 3/24 324/355
2010/0301866 A1 * 12/2010 Blessum ..... G01V 3/088 175/40
2011/0115667 A1 * 5/2011 Feigin ..... G01S 13/885 342/22
2011/0222062 A1 * 9/2011 Martini ..... G01J 3/2803 356/417
2011/0261649 A1 10/2011 Walbom et al.
2012/0175135 A1 * 7/2012 Dyer ..... E21B 47/01 166/387
2012/0229330 A1 * 9/2012 Grebennikov ..... H01P 5/222 342/175
2013/0043873 A1 * 2/2013 Brannon ..... G01V 3/22 324/355
2013/0066556 A1 * 3/2013 Bucker ..... G01V 3/24 702/2
2013/0122836 A1 * 5/2013 Desclos ..... H04B 1/04 455/121
2013/0146590 A1 * 6/2013 Einziger ..... G01S 13/89 219/709
2013/0176139 A1 * 7/2013 Chau ..... G01V 3/30 340/854.4
2013/0184995 A1 * 7/2013 Sinclair ..... G01V 11/00 702/9
2013/0260705 A1 * 10/2013 Stratford ..... H04W 24/08 455/226.1
2013/0269951 A1 * 10/2013 Tahoun ..... E21B 47/00 166/66.4
2013/0322562 A1 * 12/2013 Zhang ..... H04B 7/0808 375/267
2013/0335016 A1 * 12/2013 Jung ..... H02J 50/10 320/108
2014/0022088 A1 * 1/2014 Chau ..... E21B 44/00 340/854.1
2014/0084857 A1 * 3/2014 Liu ..... H02J 50/402 320/108
2014/0091968 A1 * 4/2014 Harel ..... H04B 17/103 342/368
2014/0125509 A1 * 5/2014 Stolarczyk ..... H01Q 1/3216 342/22
2014/0196951 A1 * 7/2014 Ritamaki ..... G01V 3/165 175/45
2014/0218225 A1 * 8/2014 Simicevic ..... H01Q 13/085 342/22
2014/0265619 A1 * 9/2014 Chau ..... H02J 50/80 307/104
2015/0002300 A1 * 1/2015 Cho ..... H04J 3/0667 340/605
2015/0021008 A1 * 1/2015 Batarseh ..... E21B 43/2401 166/57
2015/0077120 A1 * 3/2015 Olsson ..... G01V 3/02 324/326
2015/0160365 A1 * 6/2015 Donderici ..... E21B 19/22 324/351
2015/0167452 A1 * 6/2015 Godager ..... E21B 47/122 340/854.6
2015/0186894 A1 * 7/2015 Mosier ..... G06Q 50/08 705/304
2015/0201385 A1 * 7/2015 Mercer ..... H04B 1/3838 455/452.1
2015/0204995 A1 * 7/2015 Olsson ..... G01V 3/104 324/329
2015/0355372 A1 * 12/2015 Bloemenkamp ..... G01V 3/24 702/7

(56) References Cited

U.S. PATENT DOCUMENTS

| | | | | |
|---|---|---|---|---|
| 2016/0017702 | A1* | 1/2016 | Koscheev | E21B 47/0002 166/254.1 |
| 2016/0053610 | A1* | 2/2016 | Switzer | E21B 47/13 340/854.6 |
| 2016/0298443 | A1* | 10/2016 | Ariaratnam | E21B 47/14 |

OTHER PUBLICATIONS

El-qady et al., Buried Object—An Overview (Year: 2018).*

Ji et al., Crosstalk Study of Simultaneous Wireless Power Information Transmission Based on an LCC Compensation Network (Year: 2017).*

Manacorda et al., Mapping Underground Assets with Fully Innovative GPR Hardware and Software Tools (Year: 2009).*

Uaegbu et al., Ground Penetrating Radar as a Contextual Sensor for Multi-Sensor Radiological Characterisation (Year: 2017).*

Kothari, K.M., Pittard, G.T., and Cribbs, R., "Obstacle Detection System for Utility Construction Operations", article, 2003, 8 pages.

Nakauchi, T., Hayakawa, H., and Arai, I., "A Small GPR for Horizontal Directional Drilling System", article, 2006, 4 pages, Kigam, Korea.

Nakauchi, T., Nakajima, H., Lizuka, K. Watanabe, T., and Arai, T., "Development of the Intelligent Horizontal Directional Drilling Systems", article, 18 pages.

Nakauchi, T., Arai, I., and Hayakawa, H., "A Small Prospecting Radar System", article, 2000, 4 pages, Gold Coast, Queensland, Australia.

Jaganathan, A., Shah, J.N., Allouche, E.N., Kieba, M., and Ziolkowski, C.J., "Modeling of an obstacle detection sensor for horizontal directional drilling (HDD) operations", article, 2011, 8 pages, Ruston, LA.

Manacorda, G., Koch, E., Scott, H.F., and Pinchbeck, D., "The Orfeus Project: Design of a Bore-Head GPR for Horizontal Directional Drilling (HDD) Equipment", Paper, 2009, 9 pages, B-1-04, Toronto, ON, Canada.

* cited by examiner

HORIZONTAL DIRECTIONAL DRILLING CROSSBORE DETECTOR

CROSS REFERENCE TO RELATED APPLICATION

This application claims the benefit of provisional patent application Ser. No. 62/133,012 filed on Mar. 13, 2015, the entire contents of which are incorporated herein by reference.

FIELD

This invention relates generally to a sensor for detecting crossbores in horizontal directional drilling operations.

SUMMARY

The present invention is directed to a crossbore detection system. The system comprises a drill bit, a first antenna configured to transmit a series of signals, a second antenna, and a sensor. The second antenna is configured to receive the series of signals transmitted by the first antenna. The sensor detects changes in the series of signals received by the second antenna indicative of the drill bit having struck an underground object.

In another embodiment, the invention is directed to a system comprising a horizontal directional drill, a drill string rotatable by the horizontal directional drill, and a downhole tool. The downhole tool is coupled to a distal end of the drill string. The downhole tool comprises a drill bit and a crossbore detection system. The crossbore detection system comprises circuitry disposed on the downhole tool and a sensor. The sensor is capable of detecting variations circuitry caused b the drill bit crossing a path of an underground pipe.

A method for detecting a crossbore in horizontal directional drilling operations. The method comprises drilling a borehole with a downhole tool. The downhole tool comprises a first antenna, a second antenna, a sensor and a drill bit. The method further comprises transmitting a series of signals from the first antenna to the second antenna, comparing signals received at the second antenna to a reference signal indicative of a crossbore, and generating a warning if the signal received at the second antenna indicates a crossbore.

DETAILED DESCRIPTION

Figure 1:
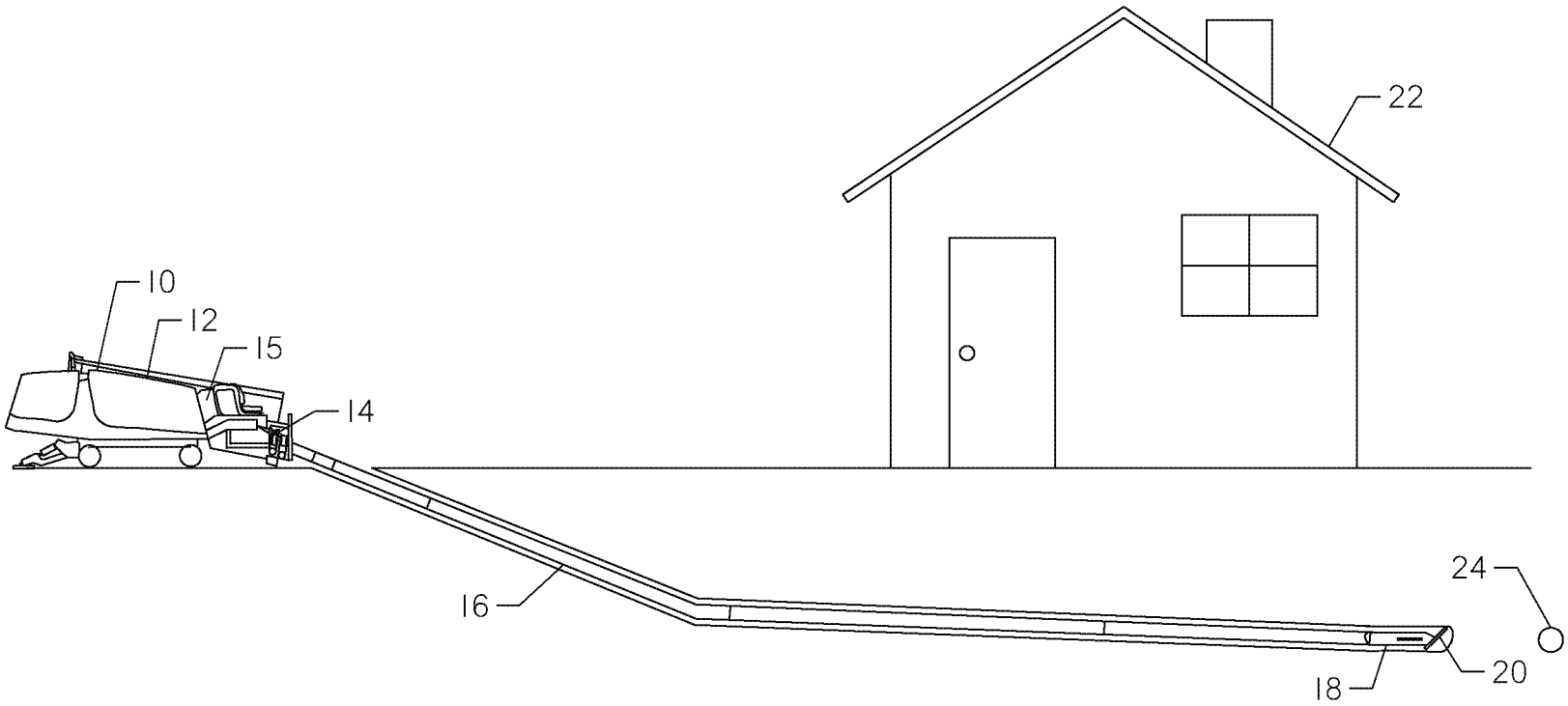
FIG. 1 is a diagrammatic representation of a horizontal directional drilling system.

With reference to FIG. 1, shown therein is a horizontal directional drill (HDD) system 10. The system 10 comprises a drilling machine 12, a carriage 14, a display 15, a drill string 16, and a downhole tool 18 located at a distal end of the drill string. The downhole tool 18 comprises a drill bit 20. The display 15 provides information at the drilling machine 12 to an operator (not shown). In FIG. 1, the drill string 16 extends under an obstacle such as house 22. An underground anomaly, such as underground pipe 24, is shown crossing in front of the drill string 16.

FIGS. 2-5C show the downhole portion of a crossbore detection system for detecting when the drill bit 20 and drill string 16 cross the path of an underground pipe 24 (FIG. 1), such as an unmarked gas pipeline. Strikes with an underground pipe 24 can cause leaks which may become significant hazards. Likewise, intersections with underground pipes that are undetected can also lead to installation of one utility line, such as an electric line or gas line, through another underground line, such as a sewer, where the hazard created is not immediate, but may have serious future consequences. While drilling using an HDD system 10, an operator must take steps to locate and avoid underground obstacles, first through location and planning of the path of the drill string 16 in such a way to avoid obstacles, and second, when the borepath approaches known obstacles, by "potholing" or excavating the area where the paths cross to visually verify that no contact between the drill bit 20 and an underground pipe 4 occurred. The present crossbore detection system is not a substitute for such methods and should be used only to notify an operator of the HDD system 10 that a strike with an unknown underground pipe 24 has occurred.

Figure 2A:
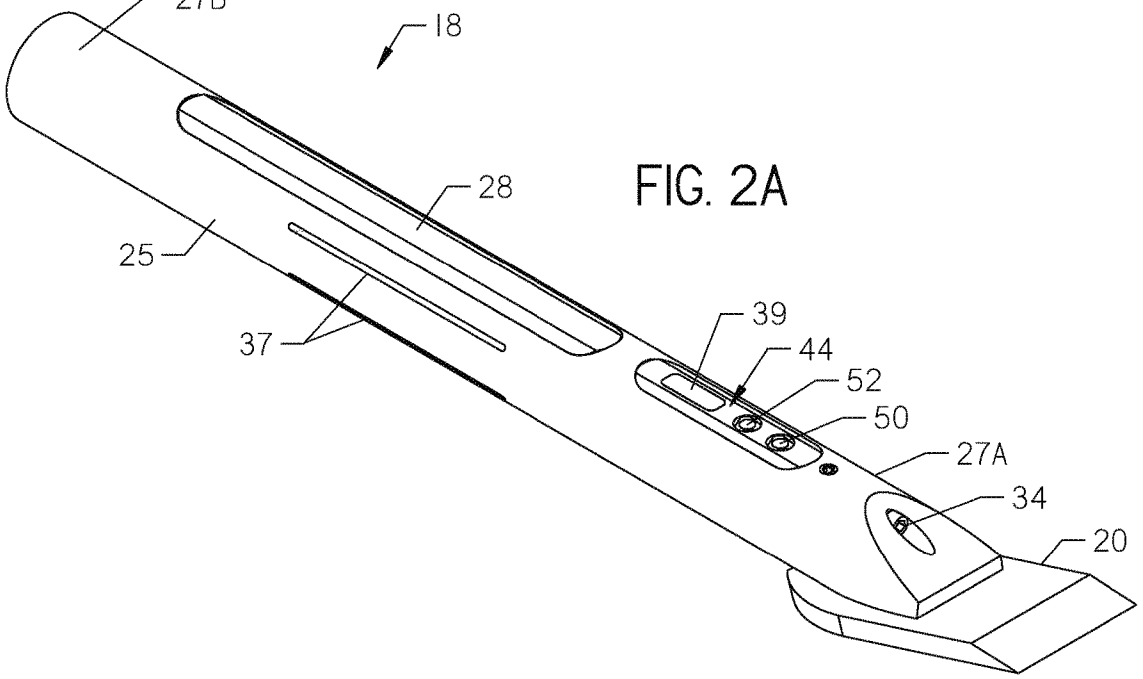
FIG. 2A is an isometric view of a downhole tool comprising the crossbore detection system of the present invention.
Figure 2B:
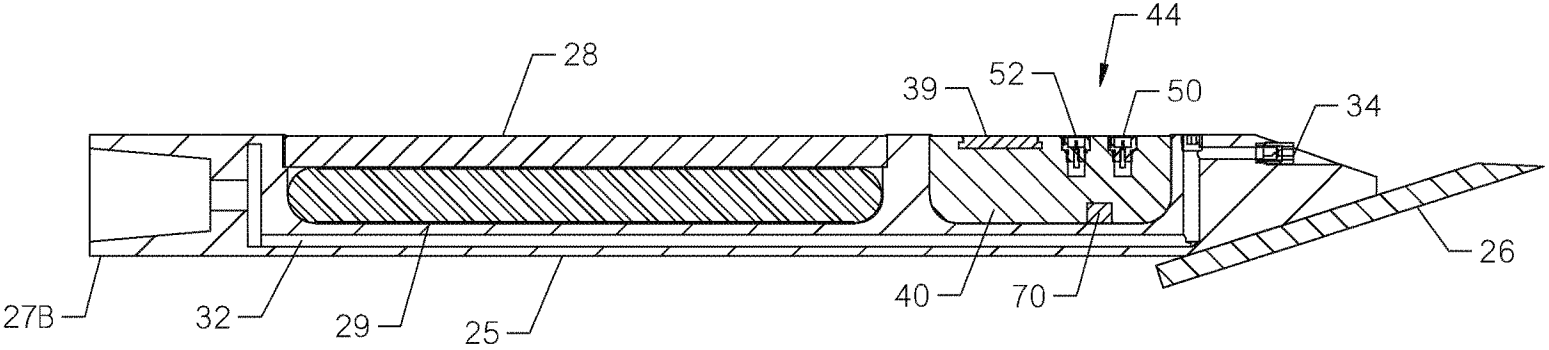
FIG. 2B is a section view of a downhole tool comprising the crossbore detection system of the present invention.
Figure 4:
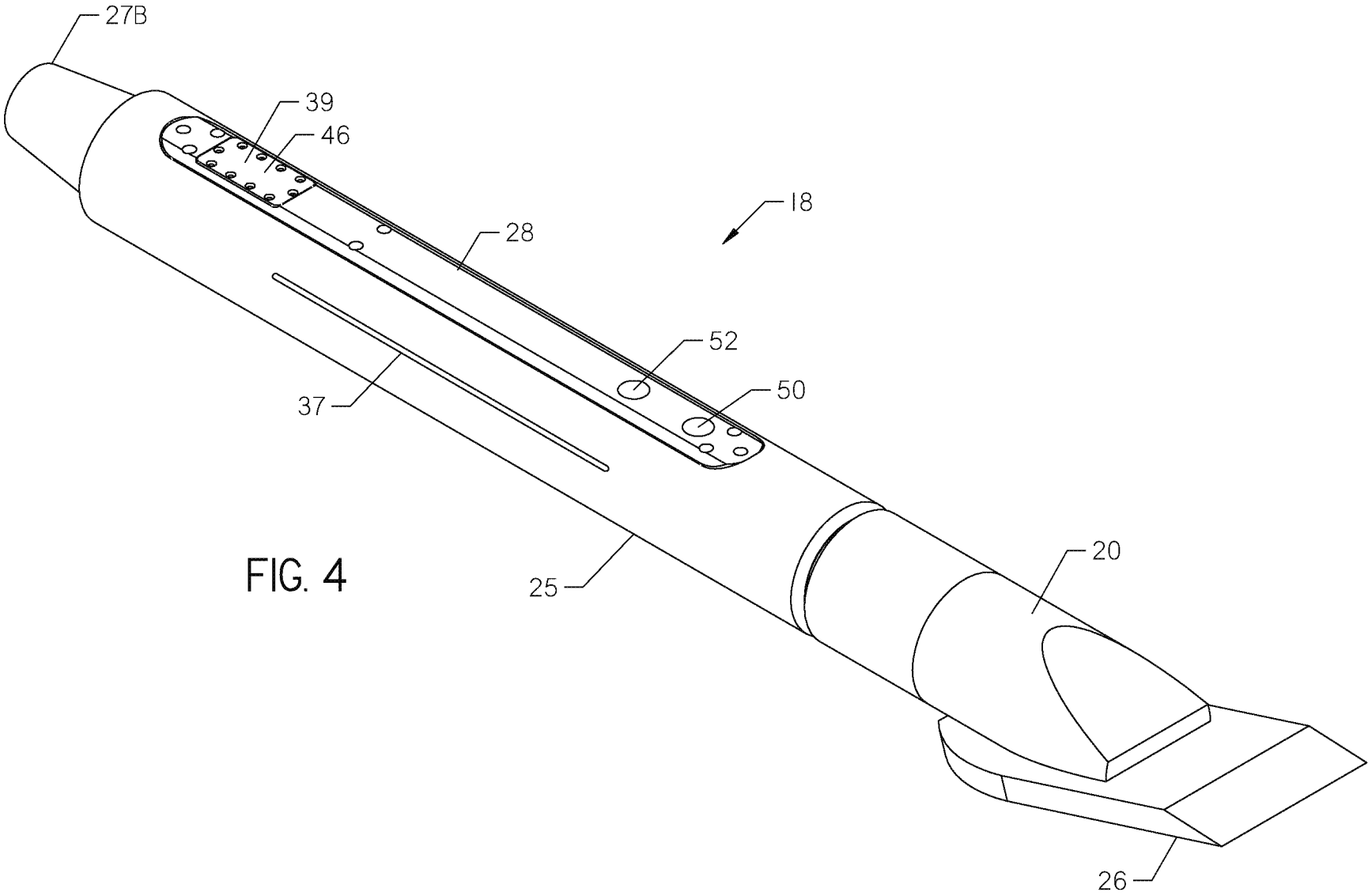
FIG. 4 is a top left perspective view of an alternate embodiment of a beacon housing comprising the crossbore detection system.

With reference now to FIGS. 2A and 2B, shown therein is a downhole tool 18 comprising the drill bit 20 and a beacon housing 25. The beacon housing comprises a distal end 27A and a proximate end 27B relative to the drilling machine 12. The drill bit 20 comprises a slant-faced cutting blade 26. The drill bit 20 is a ground-engaging member or members at the leading end of the downhole tool 18 that cuts the earthen material as the downhole tool 18 is rotated. As shown in the figures, the drill bit 20 comprises the slant-faced cutting blade 26 bolted on the drill bit 20, but it may be otherwise operatively connected. Alternatively, the drill bit 20 may comprise other types of known bits, such as those with removable carbide teeth, permanently affixed carbide teeth, PDC cutters, rotting cone elements, and others. Additionally, the downhole tool 18 of the present invention may be utilized with a backreamer during backreaming operations. As shown, the drill bit 20 is integrally formed with the beacon housing 25, although the beacon housing 25 may alternatively be attached to the drill bit 20 at a joint as shown in FIG. 4. The proximate end 27B may comprise a threaded connection, a geometrical connection, or other connection to a distal end (relative to the drilling machine 12) of the drill string 16 (FIG. 1). As shown, the proximate end 27B is a box end, though a pin end may also be utilized to connect to the drill string 16.

The beacon housing 25 comprises a lid 28 that covers a cavity for housing an internal beacon 29. Alternatively, the beacon housing 25 may be loaded with the beacon from an end. As shown, the lid 28 is located on a side of the drill bit opposite the slant-faced cutting blade 26 of the drill bit. However, the position of the lid compared to the orientation of the drill bit 20 could be in any position around the perimeter of the beacon housing 25 without altering the function of the system. The beacon housing 25 comprises a fluid flow passage 32 (FIG. 2B) disposed between the proximate end 27B and distal end 27A of the housing, and allows fluid, such as drilling fluid, to exit at one or more ports 34 proximate the drill bit 20. The beacon 29, as will be described in more detail below, is configured to transmit information related to the orientation and operation of the downhole tool 18 to an above ground location.

The downhole tool 18 contains a sensor 44 for use with the crossbore detection system. The sensor 44 comprises circuitry 40 and a communications outlet 39. The sensor 44 causes the circuitry 40 to transmit or induce a signal or series of signals, and detects variations that indicate the presence of an underground pipe 22. The circuitry 40 is utilized by the sensor 44 to provide information about the subsurface adjacent to the circuitry proximate the downhole tool 18, specifically the presence of an underground pipe 24 in a location that indicates crossbore with the drill bit 20.

In a first preferred embodiment, the circuitry 40 comprises a transmitting antenna 50 and a receiving antenna 52. The transmitting antenna 50 and receiving antenna 52 are preferably spaced apart on the downhole tool 18. As shown in FIGS. 2A and 2B, the transmitting 50 and receiving 52 antennas are spaced axially along the beacon housing 25. Other antenna placements are contemplated and shown later in FIGS. 3A, 3B, and FIGS. 5A, 5B and 5C. It wilt be understood that while the transmitting antenna 50 is shown closer to the distal end 27A of the beacon housing 25 than the receiving antenna 52, that the position of the two antennas can be switched without departing from the spirit of the invention.

The communications outlet 39 is adapted to send information from the internal circuitry 40 to an external point where it can be interpreted to determine if a crossbore has occurred. The communications outlet may comprise a radio communication antenna which transmits the information processed by the circuitry to an above ground receiver (not shown) as is known in the industry with tracking devices for horizontal directional installations. Alternatively, the circuitry 40 may comprise an internal data storage location, and communications outlet 39 may comprise a sealed electrical connection for retrieval of stored data related to the bore after the beacon housing 25 is removed from the ground at the end of the bore.

Figure 3A:
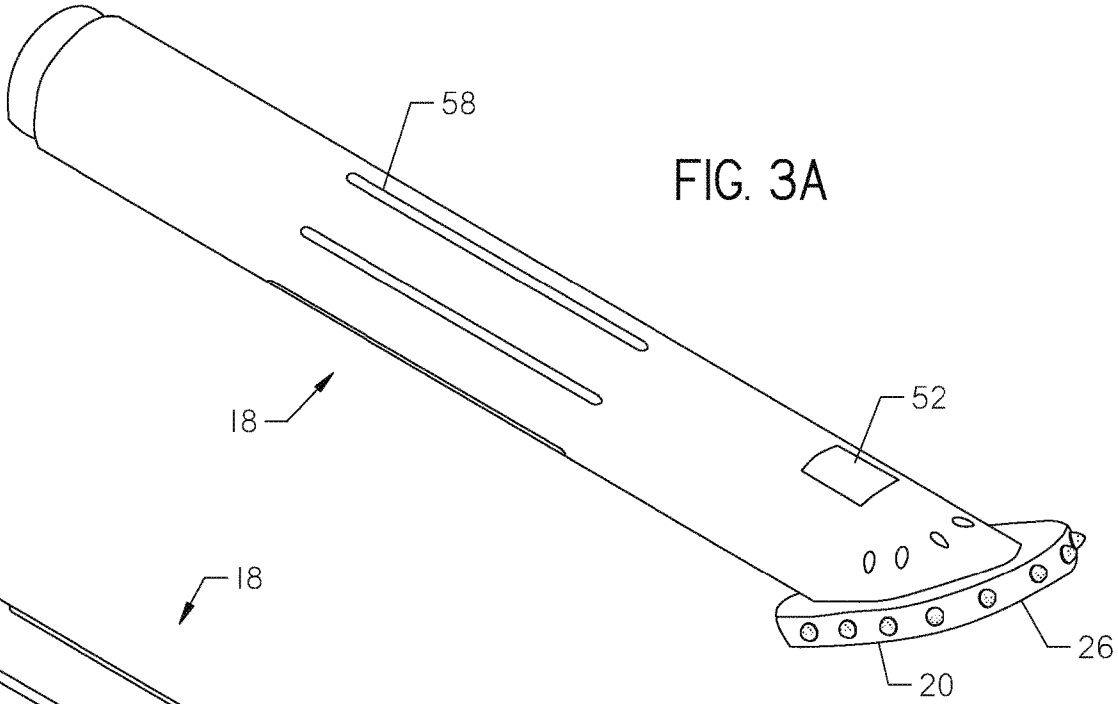
FIG. 3A is a top left perspective view of an alternative embodiment of a beacon housing comprising the crossbore detection system.
Figure 3B:
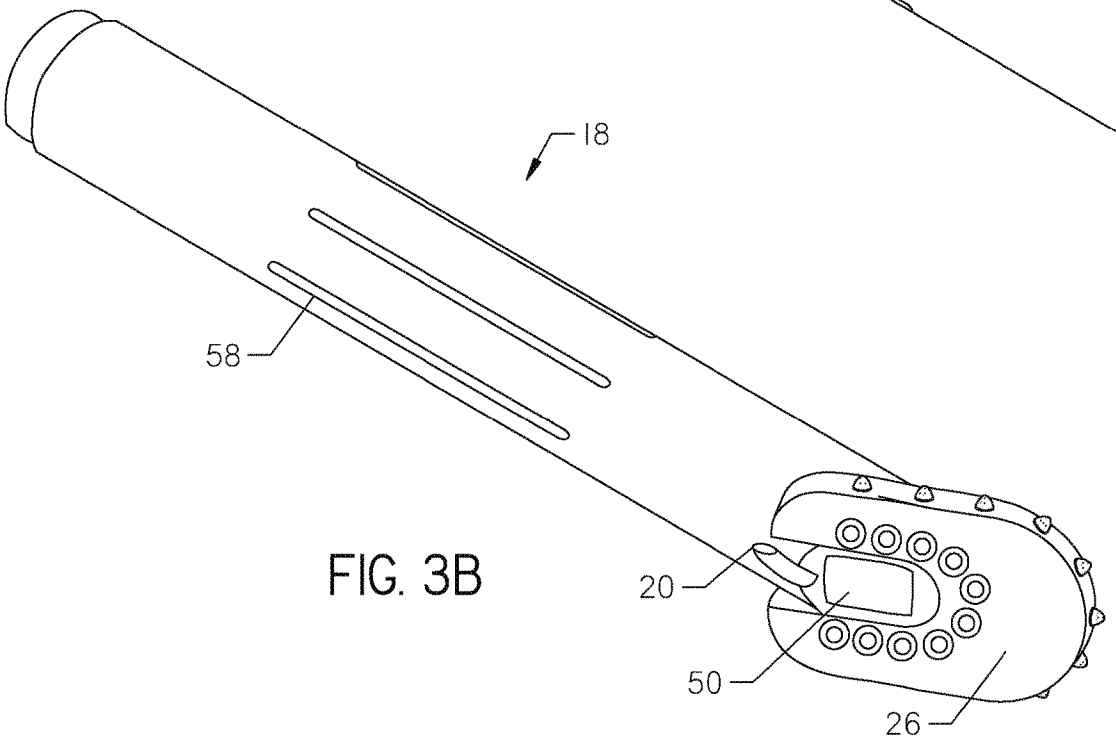
FIG. 3B is a bottom left perspective view of the beacon housing comprising the crossbore detection system of FIG. 3A.

With reference to FIGS. 3A and 3B, an alternative embodiment is shown. Shown therein, the transmitting antenna 50 is located proximate the drill bit 20 and the receiving antenna 52 is located on the beacon housing 25. The locations of the receiving 52 and transmitting 50 antennas are not limiting on the invention, and could be reversed or modified without departing from the spirit of the invention.

With reference again to FIG. 2, the sensor 44 causes the transmitting antenna 50 to transmit a continuous electromagnetic signal to the receiving antenna 52. Preferably, the electromagnetic signal operates in the microwave frequency. More preferably, the signal is between about 1 and 8 gigahertz though other frequencies may be utilized. The amount of signal cross-talk that occurs between the two antennas 50, 52 may be used to discriminate the presence of a utility pipe near the downhole tool 18, or the intersection of the drill bit 20 with a void on the interior of a buried underground pipe 24, such as a sewer line. When the drill bit 20 hits or pierces a utility pipe, the soil configuration around the downhole tool 18 changes, influencing the signal between the antennas 50, 52. This may be from the presence of a void in an underground pipe such as a sewer pipe or gas pipe, or from clear water in the case of a hit on a water line. In either case, the conductivity and dielectric constant of the area around the sensor will change compared to the soil/drilling fluid slurry the beacon housing is normally surrounded by during operation. As described with more detail with reference to FIG. 6, the sensor 44 may receive and process a signal from the receiver antenna 52 to determine the physical characteristics of the subsurface including the presence of a crossbore.

The sensor 44 may be integral with the beacon 29 or a separate unit as shown in FIG. 2. The beacon 29 contains onboard instrumentation for determining the orientation (such as yaw, pitch and roll) of the downhole tool 18, as well as sending a signal to the drilling machine 1 (FIG. 1) or an above-ground tracker (not shown) for determining the location of the downhole tool 18. The sensor 44 may send its crossbore signal using the transmitted signal from the beacon 29. Alternatively, the sensor 44 may utilize a wireline (not shown) or other wireless communication means to convey the information generated by sensor 44 to a location where personnel conducting the drilling operation can utilize the information to make decisions based on that information.

In addition, to aid in determination of striking an underground object, an accelerometer 70 may be utilized in the downhole tool 18 to indicate axial jarring or rotational inconsistency associated with the drill bit 20 contacting an underground pipe 24. Commonly, the beacon 29 will have an onboard accelerometer 70 for sensing pitch and roll orientation during the bore. The data from the accelerometer 70 in beacon 29 may also be used in conjunction with the information processed by the sensor 44 and utilized in determining whether a crossbore exists. In cases where the sensor 44 is separate from the beacon 29 (as shown in FIGS. 2A and 2B), the circuitry 40 may comprise an accelerometer 70. The accelerometer 70 may be a linear or rotational accelerometer, and may measure accelerations in one or more axes.

With reference to FIG. 4, another embodiment of the downhole tool 18 of FIG. 2 is shown. In the configuration of FIG. 4, the sensor 44 and beacon 29 are one integral unit. The transmitting antenna 50 and receiving antenna 52 of the sensor 44 are mounted on the lid 28. The communications outlet 39 may comprise a cover 47 formed in the lid 28 to protect internal components of the sensor 44 and beacon 29. The data from sensor 44 may be stored in an internal data storage location and the port cover 47 may be removed to access data stored in the sensor 44. The communications outlet 39 provides an access point for data related to the sensor 44 to be removed, either by a cable with a mating connector for the port or, alternatively, by a wireless transmission to a processor (not shown) once the bore is complete. The sensor 44 data may then be analyzed to determine whether a crossbore has taken place. Alternatively, the information from the sensor 44 could be encoded with the signals emanating from beacon 29. The information can be transmitted wirelessly through slots 37 in the beacon housing 25 to an above-ground receiver (not shown), or alternatively could be transmitted to the boring unit operator along a wireline, or wireless telemetry along drill string 16.

Figure 5C:
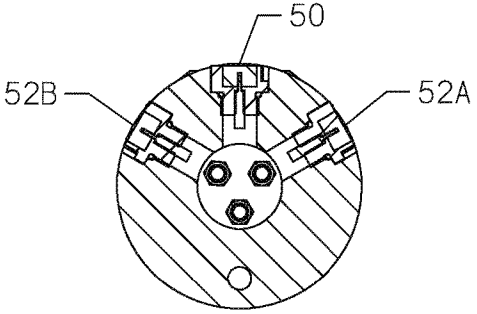
FIG. 5C is a section view of the beacon housing of FIG. 5A taken across the antennas of the sensor.
Figure 5A:
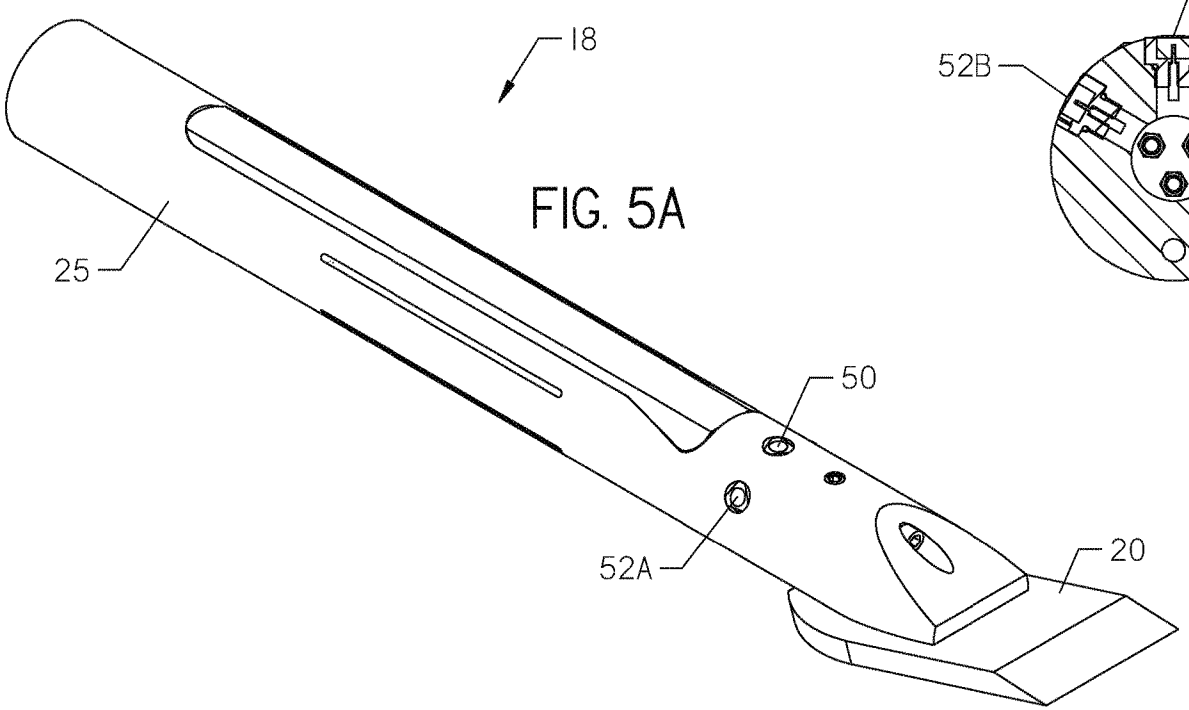
FIG. 5A is a top left isometric view of an alternative embodiment of the crossbore detection system having multiple receiving antennas.
Figure 5B:
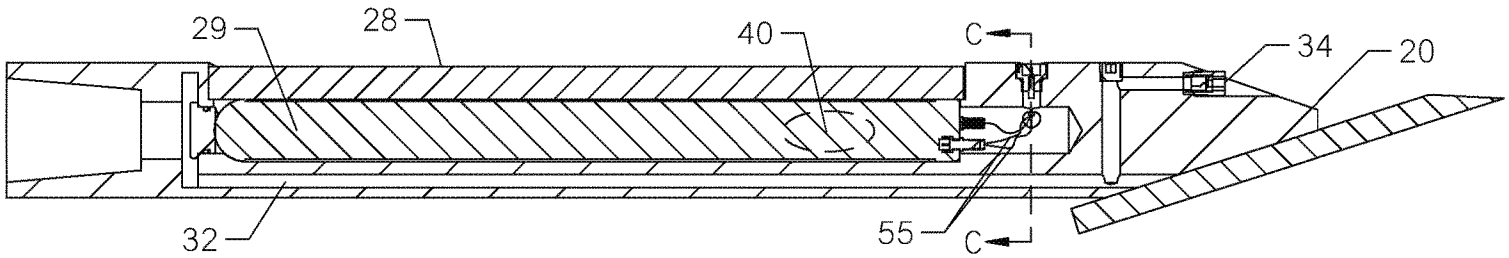
FIG. 5B is a longitudinal cross-section of the embodiment of FIG. 5A.

Alternative embodiments may be considered. For example, additional receiving antennas can be used to help detect an intersection of the downhole tool 18 with an underground line. In FIGS. 5A, 5B, and 5C, the sensor 44 is shown with a single transmitting antenna 50 and multiple receiving antennas 52*a* and 52*b*. Also illustrated in these figures is that the transmit and receive antennas can also be placed radially around the beacon housing 25 as opposed to along its axis as illustrated in FIGS. 2A, 2B, and 4. Having the multiple receiving antennas 52*a* and 52*b* spaced axially around the housing may help to detect the creation of a small opening in an underground tine if the line is hit on an edge instead of along its axis by the drill bit 20. As the housing 25 and bit are rotated, having multiple receiving antennas will help to ensure that at least one will pass through the opening and thus produce a signal indicating the presence of the opening.

In the embodiment of FIGS. 5A, 5B, and 5C the circuitry 40 for the sensor 44 is co-located within beacon 29. The antennas 50, 52*a*, and 52*b* are mounted within beacon housing 25 and connect to the circuitry 40 through cables 55 extending from the end of beacon 29 to the antennas.

Figure 6:
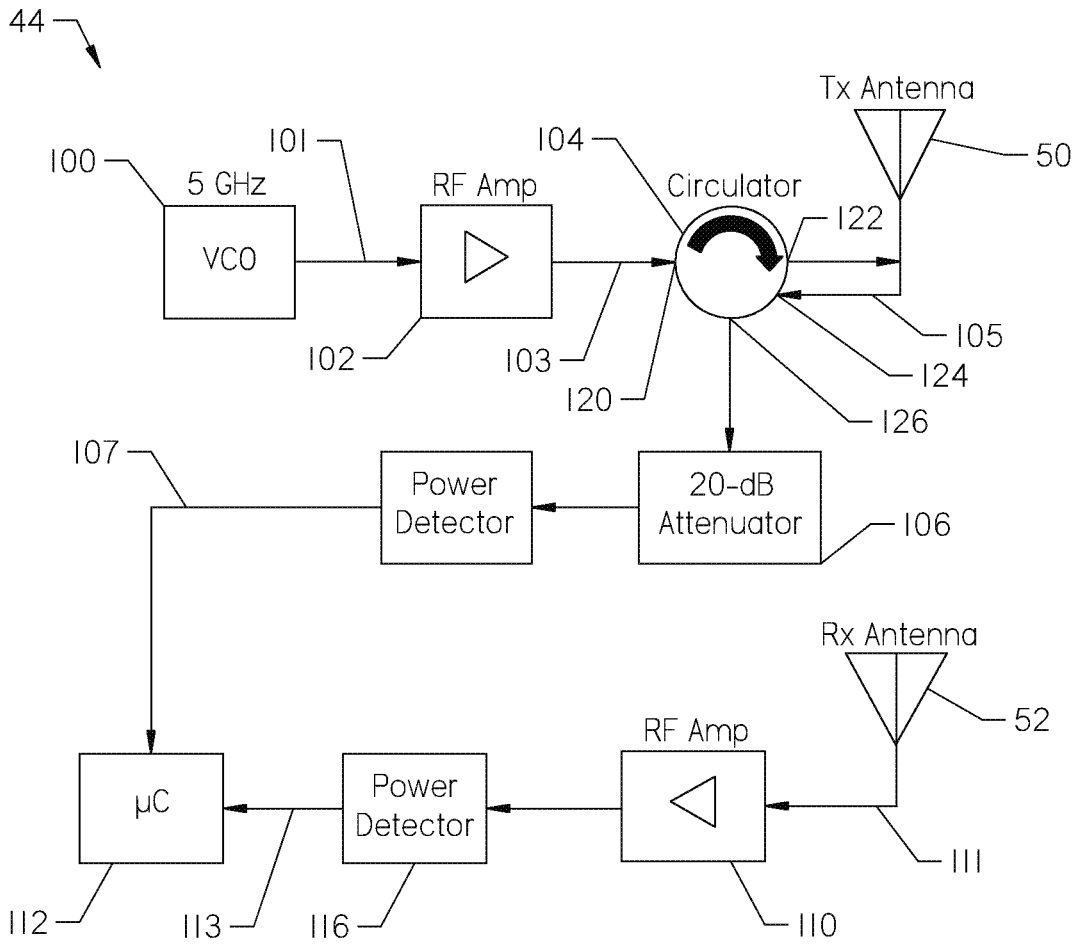
FIG. 6 is a diagrammatic representation of a crossbore sensor for use with the current invention.

With reference to FIG. 6, one particular embodiment of the sensor 44 is shown. The sensor 44 comprises a voltage controlled oscillator 100, a transmit signal amplifier 102, a circulator 104, a signal attenuator 106, a receive signal amplifier 110, and a microcontroller 112. Additionally, signals provided to the microcontroller 112 may be first converted to a DC voltage by a first power detector 114 and second power detector 116.

The voltage controlled oscillator 100 is shown providing a signal 101 having a frequency of 5 gigahertz. As discussed above, this frequency may be within the microwave range, and preferably between 1 gigahertz and 8 gigahertz. The signal 101 generated by the oscillator 100 is amplified by the transmit signal amplifier 102.

The circulator 104 comprises four ports. The first port 120 receives an amplified signal 103 from the transmit signal amplifier 102. The circulator provides the amplified signal 103 out of a second port 122 to the transmitting antenna 50. A portion of the amplified signal 103 is transmitted by the transmitting antenna 50, while a portion is reflected and routed to a third port 124 of the circulator. The amount of amplified signal 103 transmitted by the transmitting antenna 50 will vary depending on the dielectric constant of the material around the transmitting antenna. The portion of the signal reflected 105 enters the circulator at the third port 124 and is routed through a fourth port 126 to the signal attenuator 106.

The signal attenuator 106 reduces a power level of the reflected signal 105. Preferably, the signal attenuator 106 is a 20 decibel attenuator, though other amplitudes may be utilized. The reflected signal 105 may then be routed to the first power detector 114 and converted to a direct current voltage 107. This direct current voltage 107 is sent to the microcontroller 112.

The receive antenna 52 receives a received portion 111 of a transmitted signal sent by the transmitting antenna 50. The amount of the transmitted signal received will depend on the material surrounding the antennas as the sensor 44 is passed through soil. The received portion 111 is amplified b r the receive signal amplifier 110 and delivered to the second power detector 116 to convert the received portion 111 to a direct current voltage 113. The direct current voltage 113 is sent to the microcontroller 112.

The microcontroller 112 will interpret the direct current voltages 107, 113 to determine the type of material proximate the sensor 44. Primarily, the interior of an underground pipe 24 (FIG. 1) will appear to the sensor 44 as a void. In general, the received portion 111 and reflected signal 105 will go up when the sensor 44 is in the presence of a void indicative of an underground pipe 24 rather than in the presence of soil underground.

While the sensor 44 of FIG. 6 shows one transmitting antenna 50 and one receiving antenna 52, it should be understood that, like in FIGS. 5A-5C, additional antennas, such as first receiving antenna 52A and second receiving antenna 52B, may be utilized. In the embodiment of FIG. 7, the sensor 44 of FIG. 6 would show a second receiving antenna 52A and associated amplifier and power detector feeding a received portion of the transmitted signal into the microcontroller 112.

With reference again to FIGS. 2-5, the sensor 44 may, in an alternative embodiment, operate in the radio frequency range, specifically several hundred kilohertz. The circuitry 40 comprises a pair of electrodes. The electrodes are preferably a balanced impedance bridge such that the null voltage measured at standard drilling configuration is known. Any change in the environment proximate the electrodes during drilling changes the impedance across the electrodes and thus outputs a voltage differing from the original. Additional balanced electrodes may be utilized on the downhole tool 18 at different locations to allow for comparison of soil configuration all around the pipe, for example, front-top vs front-bottom impedance comparison.

In operation, the first antenna 50 and second antenna 52 are in communication with one another. This communication may take the form of an induced electromagnetic signal directed by the sensor 44. This communication may alternatively be impedance across pairs of electrodes capable of detection as an output voltage by the sensor 44. Additionally, both the capacitive and electromagnetic detection mechanisms may be used in conjunction. In any case, the sensor 44 is capable of detecting variations in the communication caused by an underground pipe 24 proximate the downhole tool 18, perhaps indicating a crossbore.

Therefore, as the horizontal directional drill 10 advances the drill string 16 and downhole tool 18, the sensor 44 monitor the communication for indications of a crossbore and stores and/or transmits the received data as sensor data. The sensor data is recorded, either at a downhole storage unit, or after transmission wirelessly or by wireline at an uphole processor. The transmission may take place instantaneously through an impulse sent by the beacon 29, or may be stored for later downloading. The information processed by the sensor 44 for determination of a crossbore may additionally include input from one or more accelerometers 70. The data from the sensor is compared to reference data for indications of a crossbore. When sensor data matches the reference data and indicates a crossbore, a warning is communicated to an operator, who may cease operations of the horizontal directional drill 10 and begin procedures to locate and expose the damage. In a preferred embodiment of the device, in the event of the downhole tool 18 intersecting an underground line 24, the sensor 44 will measure parameters of the soil area surrounding the downhole tool that indicate that the line has been hit, and will transmit an indication of the intersection to the drilling machine 12 where it may be displayed on the display 15 in real time to alert the drilling machine operator of the event.

Various modifications can be made in the design and operation of the present invention without departing from its spirit. As described, the relative location and number of communicative devices is not limiting on the invention and different configurations may be utilized. Thus, while the preferred construction and modes of operation of the invention have been explained in what is now considered to represent its best embodiments, it should be understood that within the scope of the appended claims, the invention may be practiced otherwise than as specifically illustrated and described.

What is claimed is:

1. A crossbore detection system comprising:

a downhole tool;

a first antenna and a second antenna supported on the downhole tool and maintained in steady-state communication by electromagnetic signals that propagate along a path interconnecting the two antennas;

a sensor responsive to the signals emitted from the first antenna and responsive to the signals received at the second antenna; and a microcontroller configured to analyze the signals emitted from the first antenna compared to the signals received at the second antenna;

in which the sensor is configured to detect the power of signals emitted from the first antenna and the power of signals received at the second antenna, and in which the microcontroller is configured to analyze the power of signals emitted from the first antenna compared to the power of signals received at the second antenna.

2. The crossbore detection system of claim 1 wherein a frequency of the signals is between about 1 gigahertz and 8 gigahertz.

3. The crossbore detection system of claim 1 further comprising a transmitter capable of receiving signals from the sensor and transmitting signals to an above ground receiver.

4. The crossbore detection system of claim 1 wherein the downhole tool comprises a housing connected to a drill bit wherein the second antenna is disposed on the housing.

5. The crossbore detection system of claim 4 wherein the first antenna is disposed on the housing.

6. The crossbore detection system of claim 1 further comprising an accelerometer.

7. The crossbore detection system of claim 1 wherein the second antenna comprises a front face, wherein the front face of the second antenna is substantially parallel with a cutting blade supported on the downhole tool.

8. A system comprising:

a horizontal directional drilling unit;

a drill string coupled to the horizontal directional drilling unit;

an above ground receiver;

the crossbore detection system of claim 1 located on a distal end of the drill string.

9. The system of claim 8 wherein the above ground receiver is located at the horizontal directional drilling unit.

10. The crossbore detection system of claim 1 wherein the sensor further comprises a circulator, wherein the circulator receives a reflected signal from the first antenna.

11. A system comprising:

a horizontal directional drill;

a drill string rotatable by the horizontal directional drill;

a downhole tool coupled to a distal end of the drill string, wherein the downhole tool comprises:

a drill bit; and a crossbore detection system comprising:

a first electromagnetic transmitting antenna disposed on the downhole tool configured to transmit a signal;

a second electromagnetic receiving antenna disposed on the downhole tool and receiving the signal continuously; and a sensor capable of detecting variations in the signal emitted from the first electromagnetic transmitting antenna as compared to the signal received at the second electromagnetic receiving antenna; in which the sensor is capable of detecting variations in the power of the signal emitted from the first electromagnetic transmitting antenna as compared to the power of the signal received at the second electromagnetic receiving antenna; and a microcontroller for interpreting the detected variations.

12. The system of claim 11 wherein the first electromagnetic transmitting antenna is disposed on the drill bit.

13. The system of claim 11 further comprising an accelerometer disposed within the downhole tool.

14. The system of claim 11 further comprising a transmitter disposed within the downhole tool, wherein the transmitter emits a signal when the sensor detects the variations in the signal.

15. The system of claim 11 wherein the sensor comprises a circulator, wherein the circulator receives a reflected signal from the first electromagnetic transmitting antenna.

16. The system of claim 15 wherein the microcontroller is configured to interpret the reflected signal and the signal detected at the second electromagnetic receiving antenna.

17. A method of operating a downhole tool comprising:

drilling a borehole with the downhole tool comprising a first antenna, a second antenna, and a sensor;

transmitting signals from the first antenna to a second antenna through an adjacent subsurface region along a continuous path;

detecting the signals emitted from the first antenna using the sensor;

detecting the signals received at the second antenna using the sensor;

comparing the signals emitted from the first antenna to the signals received at the second antenna;

in which the sensor detects the power of the signals emitted from the first antenna and detects the power of the signals received at the second antenna, and in which the power of the signals emitted from the first antenna are compared to the power of the signals received at the second antenna.

18. The method of claim 17 further comprising storing received signal data in the downhole tool and uploading the signal data from at a port.

19. The method of claim 17 wherein the first antenna is disposed on a drill bit supported on the downhole tool.

20. The method of claim 17 wherein the signals comprise a frequency between about 1 gigahertz to about 5 gigahertz.

21. The method of claim 17 further comprising the step of measuring a power of the signals emitted from the first antenna and measuring a power of the signals received at the second antenna.

22. The method of claim 21 wherein the power of the signals is measured by a power detector.

23. The method of claim 22 further comprising the step of converting the power measured to a direct current voltage.

24. The method of claim 17 further comprising generating a warning in response to a predetermined result to the comparison step.

25. The method of claim 24 comprising generating the warning at a drilling machine.

* * * * *